United States Patent [19]

Victoreen

[11] 4,109,116

[45] Aug. 22, 1978

[54] HEARING AID RECEIVER WITH PLURAL TRANSDUCERS

[76] Inventor: John A. Victoreen, 1314 Druid Rd., Maitland, Fla. 32751

[21] Appl. No.: 817,021

[22] Filed: Jul. 19, 1977

[51] Int. Cl.[2] ..... H04R 25/00

[52] U.S. Cl. ..... 179/107 E; 179/182 R

[58] Field of Search ..... 179/107 R, 107 E, 115.5 PS, 179/116, 182 R, 182 A, 1 FS, 1 ST; 181/129, 130, 131, 132, 133, 134, 135, 136, 137

[56] References Cited

U.S. PATENT DOCUMENTS

| | | | |
|---|---|---|---|
| 752,921 | 2/1904 | Pape | 179/107 R |
| 2,634,337 | 4/1953 | Bland | 179/107 E |
| 2,989,597 | 6/1961 | Victoreen | 179/107 R |
| 3,772,478 | 11/1973 | McCabe et al. | 179/1 ST |

*Primary Examiner*—George G. Stellar
*Attorney, Agent, or Firm*—Roger L. Martin

[57] ABSTRACT

A hearing aid has an electroacoustic transducing means involving face-to-face diaphragms that are driven in opposite directions to avoid imparting mechanical vibrations to the case and thus to reduce acoustic feedback occasioned by case vibrations. The diaphragms have maximum dimensions less than the sound pressure wavelengths produced in translating the amplified signal. Separately housed transducers with respective diaphragms and drivers arranged in a symmetrical arrangement are shown and a closed acoustical arrangement between the diaphragms and ear drum of the user is contemplated.

10 Claims, 11 Drawing Figures

HEARING AID RECEIVER WITH PLURAL TRANSDUCERS

BACKGROUND OF THE INVENTION

This invention relates to a hearing aid of the type having a sound pressure outlet passageway that, in use, is directly coupled to the ear canal and more particularly to a hearing aid with an improved output transducer for suppressing feedback occasioned by the mechanical vibration of the case that houses the transducer.

Feedback problems are present in all sound amplification systems that involve an input microphone and an electroacoustical transducer for generating acoustical sound pressures and where the output transducer in located in the proximate area of the microphone or sound input transducer. With public address or P.A. systems, an acoustic air path exists between the output transducer and microphone, and sound pressures generated by the output transducer can traverse an air path back to the input microphone. In such "open acoustical systems", if the total gain exceeds about 1:1 at the interface of the vibrating member of the input microphone, sustained regenerative oscillations are set up. The amount of overall signal amplification usable in such systems is normally limited so that which doesn't produce the sustained oscillations caused by the feedback of the transducer output ot the input microphone.

In hearing aid systems, feedback problems are aggravated by the close proximate locations of the microphone and output transducer and by the further fact that it is not uncommon for an acoustical gain of 1000:1 to be required in order to compensate for the hearing impairment of the hearing aid user. With this magnitude of amplification, the transducer output pressure must be channeled directly into the user's ear canal through the use of a properly fitting ear mold so as to avoid establishment of a return air path to the microphone. In this type of "closed acoustical system", however, feedback is still a major problem because mechanical vibrations from the mechanical parts of the transducer are imparted to the case that houses the output transducer. Such mechanical case vibrations generate sound pressures in the surrounding air which find an air path back to the microphone, and all despite the basically closed nature of the acoustical system.

While the problems of case vibration and their resultant effect in producing feedback are known, the efforts to solving the problems have been primarily directed to providing vibration dampening structures in the casing area which surrounds the output transducer housing and, at the expense of added weight, to strengthening the housing and supporting structures for the transducer components so as to add a vibration attenuating mass factor to the supporting structure.

It has been known, since long prior to the advent of the modern hearing aid systems, that vibrations imparted to the base mount of a loud speaker can be minimized by using a pair of diaphragms that are mounted in a face-to-face relation, if the diaphragms are driven in opposite directions by symetrically arranged drivers (see British Pat. No. 241,343). However, when such a speaker arrangement is housed in a surrounding case, the air chambers at the back sides of the diaphragms act as resonance chambers and the case vibrates for reasons of an air coupling between the diaphragms and the casing walls. This can only be partly suppressed through the extensive use of dampening materials, and as far as is known, this type construction has not enjoyed commercial acceptance.

The ultimate effects of feedback in hearing aids are several. For one, the feedback problems in hearing aids have always limited the amount of amplification gain that could be attained without interference from the sustained oscillation that develop from feedback. Consequently, potential users who need higher amplifications than those permissible because of the sustained oscillations have been deprived of the use of hearing aids. Secondly, the feedback problems with hearing aids have actually caused damage to the hearing of some users. For example, it is known that through periodic exposure to the sustained oscillations caused by feedback, some users have developed an inability to detect the oscillations and hence, have lost a sense of perception of the frequencies involved. Thirdly, many hearing aid manufacturers purposely design their circuitry to provide a poor response in the higher frequency ranges in order to avoid some of the feedback problems. As such, the users are denied the hearing of a full frequency spectrum.

SUMMARY OF THE INVENTION

The applicant has found that the resonance chamber problem associated with loud speakers utilizing large facially confronting diaphragms is avoided when the principle is embodied in the structure of a hearing aid. In retrospect, the results of the findings are attributed to the fact that the highest frequencies encountered in hearing aid systems have wave lengths that normally exceed the longest dimensions of the diaphragms used in the hearing aids whereas, in normal loud speaker systems, the wave lengths of the high frequencies are invariably less than the diaphragm and housing dimensions so that the resonance problems which occur in the latter system are absent in the former system.

The invention relates to hearing aids and contemplates an arrangement utilizing a pair of facially confronting diaphragms that are driven in opposite directions. The diaphragms and their drivers may share a common housing and are symetrically mounted in the transducer casing. With the findings however, the applicant has been able to utilize separately housed electroacoustic transducers which are commercially available and which heretofore, when embodied individually in hearing aid systems, were less than satisfactory because the case vibrations developed and caused feedback problems. Thus, by mounting a pair of such separately housed transducers in a symetrical arrangement within the casing for the receiver, the case vibrations that lead to feedback are effectively suppressed and without the need for special amounts and materials for vibration dampening purposes.

A general object is to provide an improved hearing aid that minimizes the problems of feedback.

Another object is to provide an improved output transducer for a hearing aid and which is designed to suppress mechanical vibrations that lead to feedback problems.

Yet another object is to provide an improved output transducer for hearing aids that minimizes mechanical case vibrations and utilizes standard readily available components.

Still another object is to provide improvements in hearing aids that permit the use of higher amplifications without encountering feedback problems.

Still another object is to provide improvements that will minimize hearing loss occasioned by periodic exposure to sustained oscillations caused by sound pressure feedback.

Yet another object is to provide improvements that enable attainment in hearing aids of a better frequency response in the higher frequency ranges.

Figure 1:
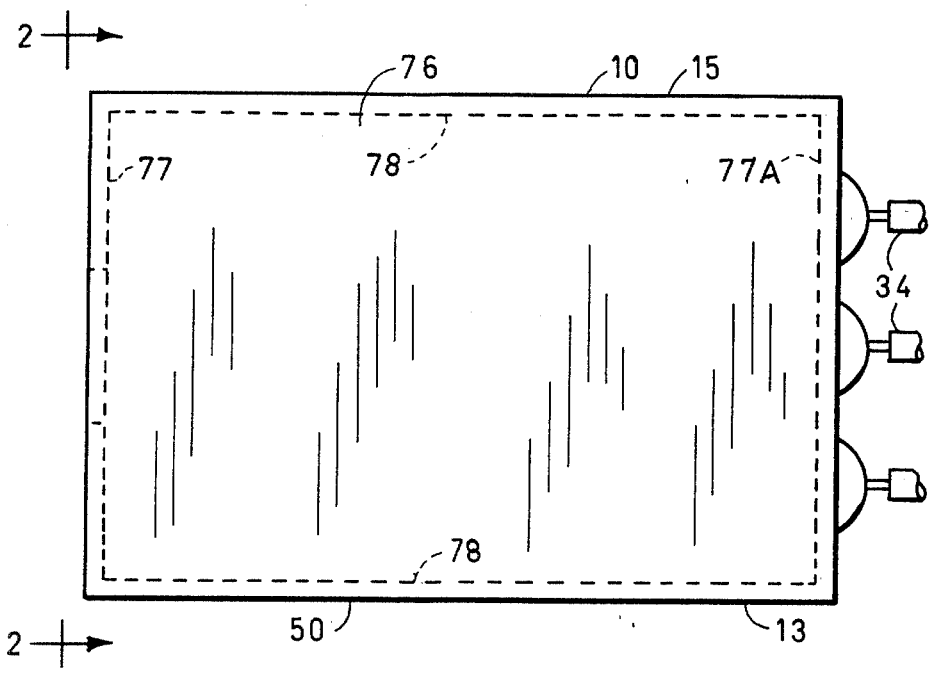
FIG. 1 is a top plan view of a transducer commonly employed in hearing aid applications.
Figure 2:
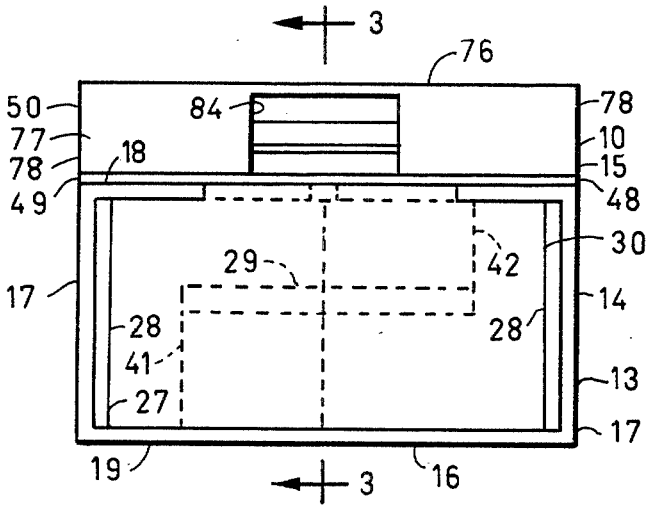
FIG. 2 is an end view of the transducer as generally seen along the lines 2—2 of FIG. 1.
Figure 4:
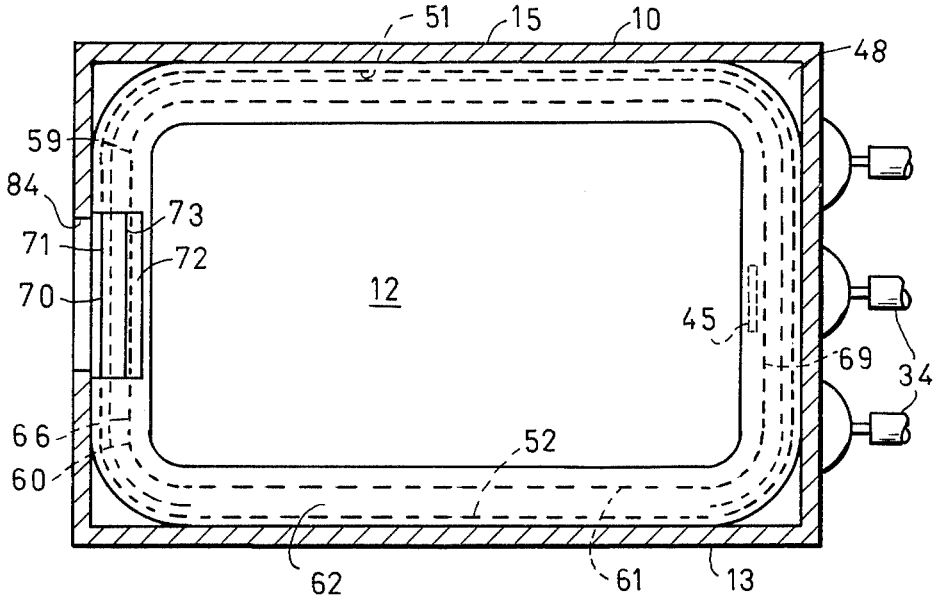
FIG. 4 is a sectional view taken generally along the lines 4—4 of FIG. 3.
Figure 3:
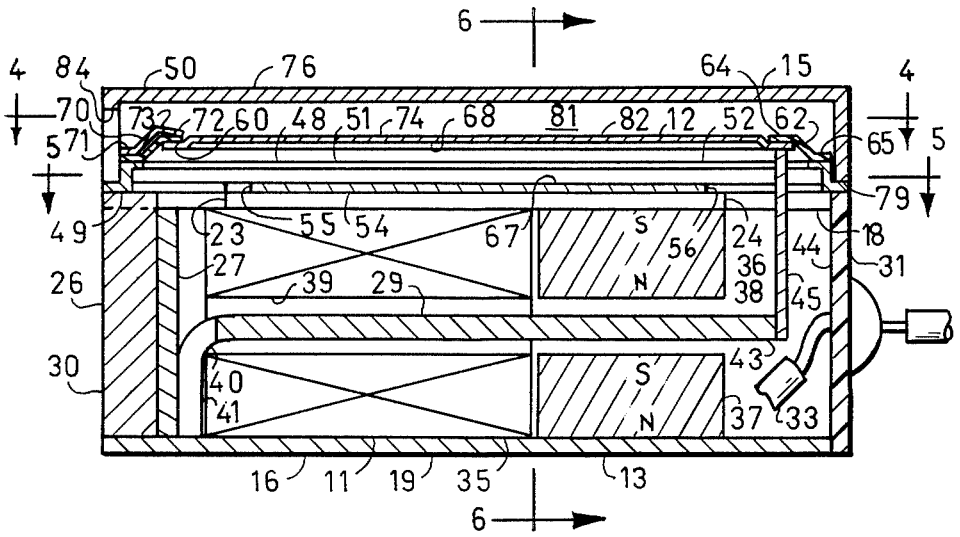
FIG. 3 is a longitudinal sectional view taken generally along the lines 3—3 of FIG. 2.
Figure 5:
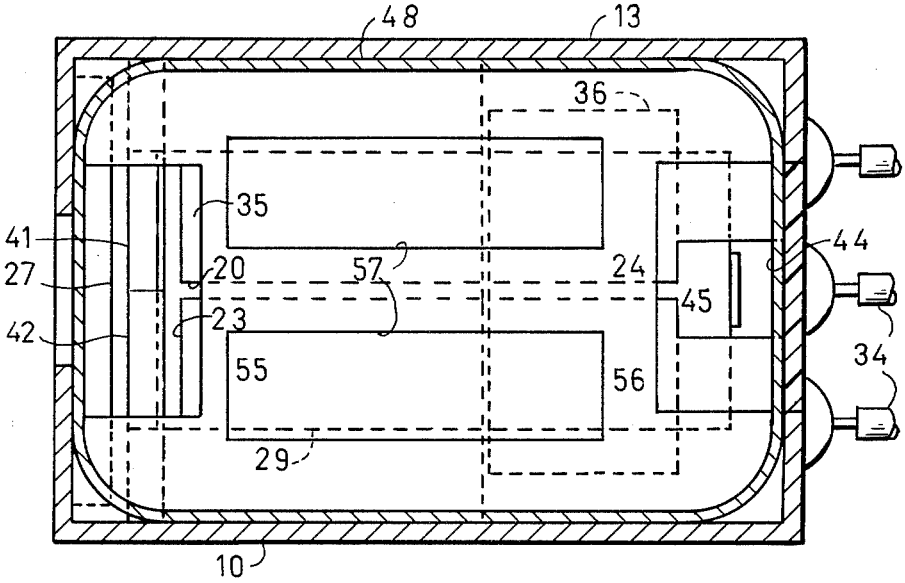
FIG. 5 is a sectional view taken generally along the lines 5—5 of FIG. 3.

FIG, 6 is a transverse sectional view taken generally along the lines 6—6 of FIG. 3.

Figure 7:
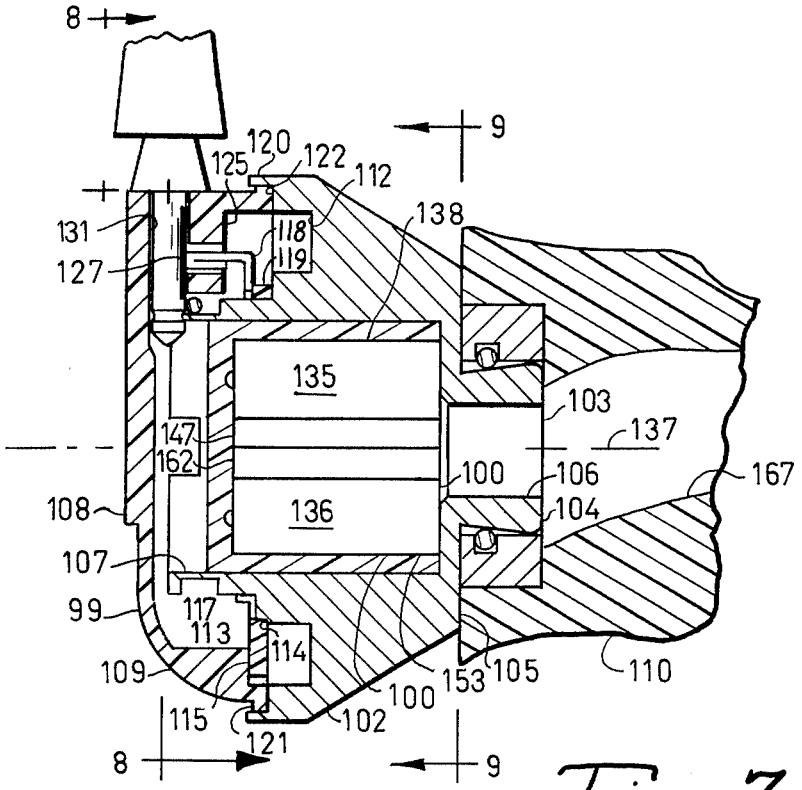
Figure 8:
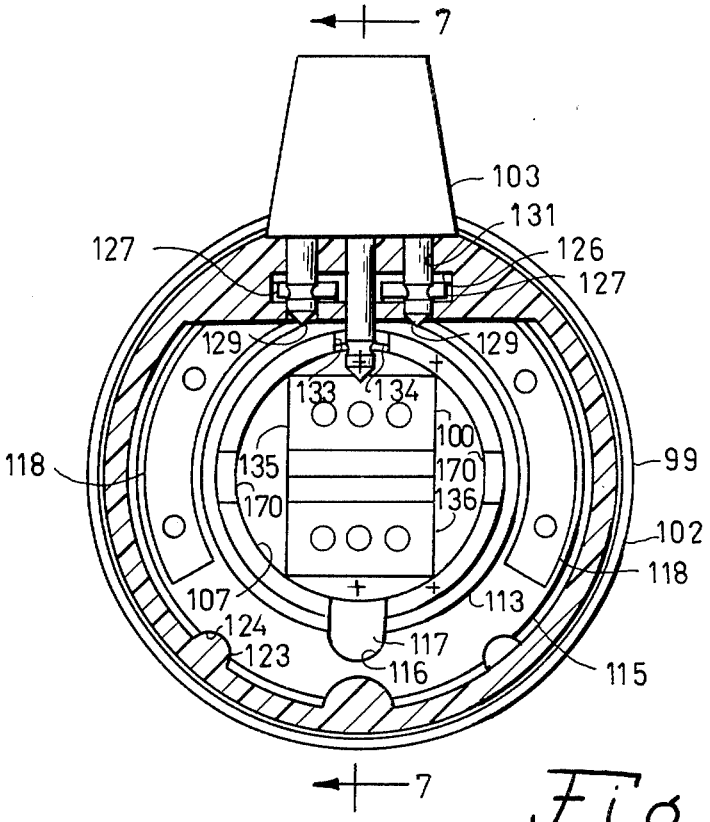

FIG. 7 is a sectional view along the axis of an earphone embodying the principles of the invention, and showing a fragment of an attached ear mold, the view being taken generally along the lines 7—7 of FIG. 8.

FIG. 8 is a transverse sectional view taken generally along the lines 8—8 of FIG. 7.

Figure 9:
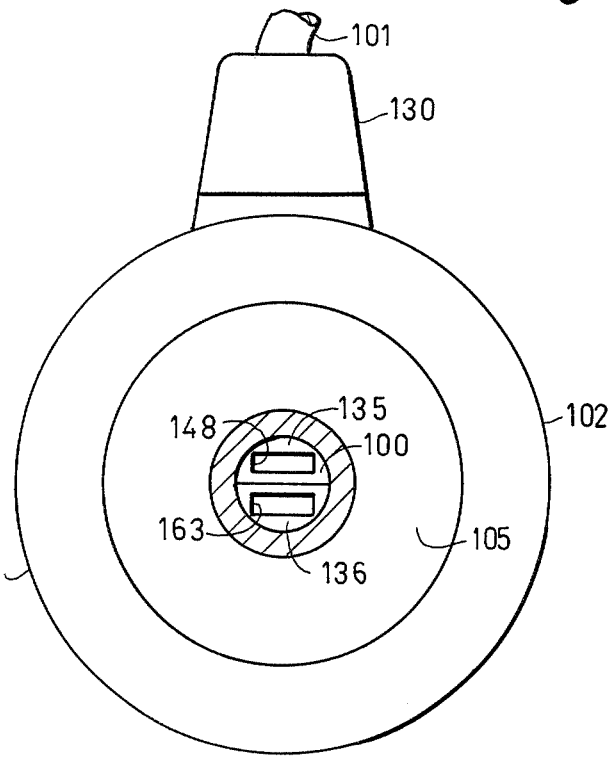

FIG. 9 is a transverse sectional view taken along the lines 9—9 of FIG. 7.

Figure 10:
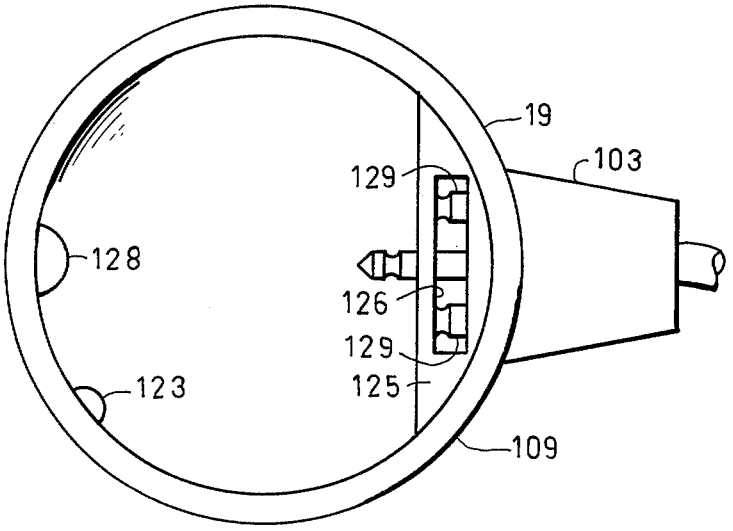

FIG. 10 is a view looking at the inside of the cover for the case, and

Figure 11:
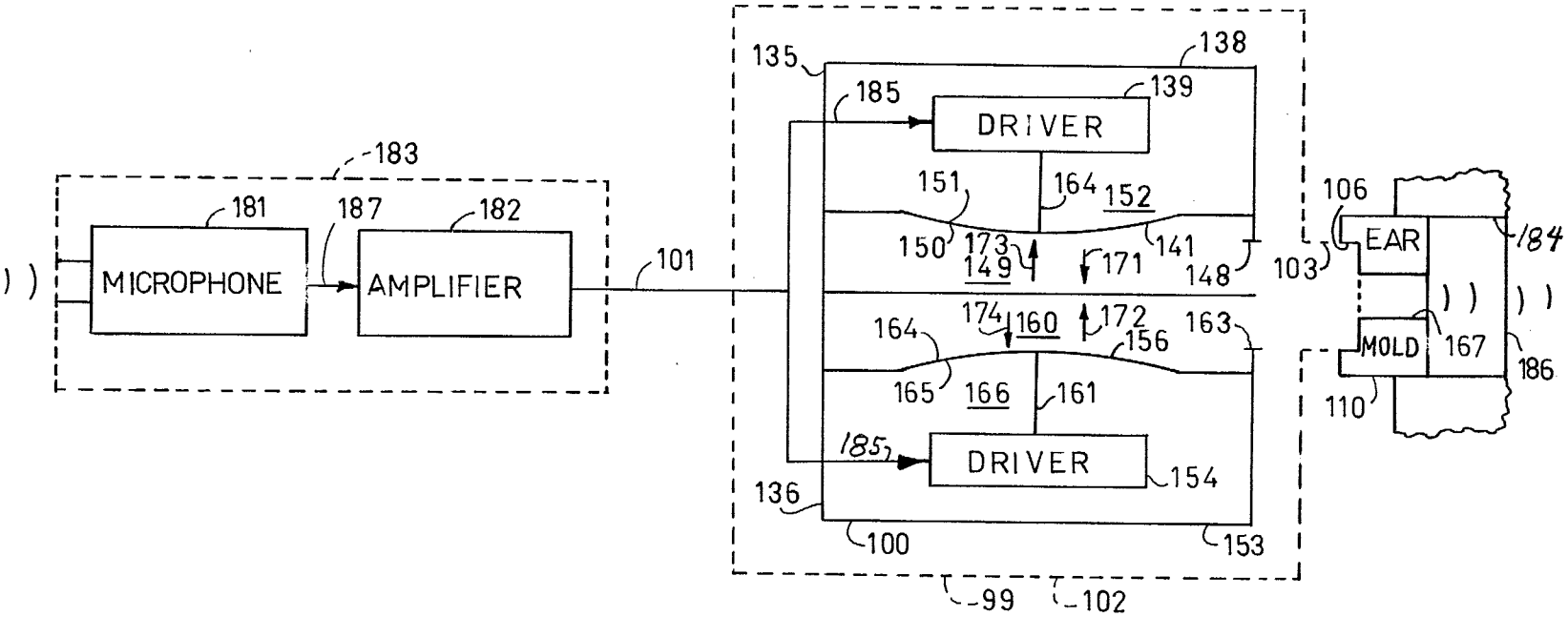

FIG. 11 is a diagramatic illustration showing the use of the earphone in a body type hearing aid.

DESCRIPTION OF THE INVENTION

Reference is first made to FIGS. 1-6 and which illustrate a better quality commercially available electroacoustic output transducer that is commonly used in hearing aid applications. The transducer 10 is of the type having an electromagnetic driver 11 for the diagram 12 but other types of drivers may be used in carrying the invention into practice, a piezoelectric crystal driver being readily adaptable for use in the application of the principles of the invention.

The transducer 10 has a generally rectangular housing 13 that includes a compartment 14 for housing the driver 11 and another compartment 15 for housing the diaphragm 12. The bottom wall 16, opposite side walls 17 and top wall 18 of the driver compartment 14 are formed from a one piece ferromagnetic metal component 19 that is bent into the form of an open ended rectangular box-like structure so as to encompass the driver components. The opposite ends of the metal piece 19 are spaced apart in the top wall structure 18 to provide a gap 20 in the top wall 18. The top wall has cutouts which provide openings 23 and 24 between the driver compartment 14 and the diaphragm compartment 15 and which facilitates enlargement of the sound chamber at the back side of the diaphragm.

At the coil end 26 of the driver compartment 14, a U-shaped or channel-like metal component 27 is mounted with its opposite legs 28 flush against and secured by a suitable glue or adhesive to the opposite side walls 17 of the structure. This metal channel member 27 serves as the mounting plate for the armature 29 of the driver and a generally rectangular metal member 30 is mounted between the legs 28 and secured by an appropriate adhesive to channel 27 and to the top and bottom walls 18 and 16 of the compartment to provide further rigidity for the armature mounting plate. The other end 31 of the compartment 14 is closed by a generally rectangular circuit board 33 that is glued to the surrounding piece 19 and provided with soldered connections that electrically link the internal and external electrical lead 33 and 34.

The driver 11 includes a pair of permanent magnets 36 and 37 which are spaced apart to provide an air gap 38 for magnetic flux between the magnets. These magnets 36 and 37 are glued and rigidly secured to the top and bottom walls 18 and 16 respectively and are arranged so that pole faces of opposite polarity confront the gap area 38. The wall forming metal piece 19 in this arrangement provides the return path for the magnetic flux.

The coil 35 is mounted at the mounting plate end 26 of the compartment and is rigidly secured by glue to the top, opposite side, and bottom walls with the center opening 39 through the coils being generally aligned with the gap area 38 between the magnets.

The armature 29 is an elongated rectangular member that extends through the coil opening 39 and the gap area 38 between the magnets. At its base end 40, the armature is bifurcated to provide two flat legs 41 and 42 which are bent to normal opposite positions relative to the general plane of the member 29. These legs 41 and 42 are rigidly secured to the channel member 27 as by spot welding or a suitable adhesive. The outer or free end 43 of the armature projects into a space 44 between the magnets and the circuit board. At this end 43, the armature is provided with an elongated connector 45 that is secured at its lower end to the armature and at its upper end to the diaphragm.

The diaphragm compartment 15 has a generally rectangular stamped metal piece or componet 48 that is fixed on the top wall 18 of compartment 14 so as to provide a mount for the diaphragm 12. This stamping provides a bottom flange 49 which is rigidly secured to the top wall of compartment 14 and it also provides a seat for the cover component 50 of the structure. The stamped component 48 has a center cutout of general rectangular configuration with rounded corners that provides an opening 51 for the diaphragm 12. Here, the metal component 48 has an endless inwardly extending lip 52 that surround the opening 51 for the diaphragm and to which the diaphragm is secured.

The flange 49 of the metal component 48 surrounds another flat, generally rectangular metal componet 54 with rounded corners and which is rigidly secured to the top wall 18. Component 54 has an end cutout which provides a rectangular opening 55 that communicates with the opening 23 in the top wall at the coil end of the driver compartment. At the other end, component 54 has another cutout which provides an opening 56 above and which surrounds the opening 24 at the connector end of the driver housing 14. This plate component 54 also has a pair of spaced apart cutouts between the end openings 55 and 56 and which provide a pair of rectangular recesses 57 in the bottom wall structure of the diaphragm compartment 15 for dampening purposes.

The diaphragm 12 may be of any conventional structural design but as illustrated, includes a light weight generally rectangular copper or aluminum foil center section member 59 with rounded corners and which is stamped to provide a peripheral flange 60 along its outer edge 61. This edge 61 is generally inset from the surrounding lip 52 of the diaphragm supporting component 48 and here, the diaphragm 12 is equipped with a flexible filamentous marginal component 62 made from a sheet of thin flexible plastic material. This marginal component 62 of the diaphragm 12 has an inner edge portion 64 that overlies and is glued to the flange 60. The outer edge portion 65 of the marginal componet 62 generally follows the contour of the lip 52 of the mounting member 48 and here, the flexible component 62 is securely glued to the lip. The foil member 59 is of course, somewhat stiffer or less flexible than the marginal component 62 and this tends to desirably limit the vibration modes in the frequency ranges encountered.

This arrangement of the diaphragm basically provides a chamber 67 at the back or bottom side face 68 of the diaphragm 12 and which communicates with the compartment area for the driver 11 through the openings 23 and 24. Compartment 14 and chamber 67 have an absence of any sound pressure transmitting passageways to the exterior of the housing and hence, the chamber 67 is acoustically sealed from the exterior of the transducer housing 13.

The connector 45 is glued to the underside of the copper flange 60 at one end 69 of the foil component 59. At the other end 66, the diaphragm 12 is provided with a generally rectangular foil type metal dampening member 70 which is fixed as by gluing at its outer edge 71 to the lip overlying edge portion of the marginal diaphragm portion. At its inner edge 72, it is fixed to the flange overlying portion of the marginal sheet member 70. Between the edges 71 and 72, the member 70 is bent along a crease line 73 that is upwardly offset from the marginal component 62 of the diaphragm. This arrangement serves with the support provided by the connector 45, to support the diaphragm 12 at a null position 74 that is slightly above the opening 51 in the diaphragm mounting component.

The cover is a one piece stamped component that has a rectangular top wall 76, opposite end walls 77 and 77A and opposite side walls 78. The lower edges 79 of walls 77, 77A and 78 rest on the bottom flange 49 of the support component 48 for the diaphragm and in the assembled housing 13 are securely glued to the flange 49. This arrangement provides a chamber 81 at the front side face 82 of the diaphragm. End wall 77 has a cutout that provides a sound pressure outlet 84 from the chamber 81 and which communicates with the exterior of the housing.

Figure 6:
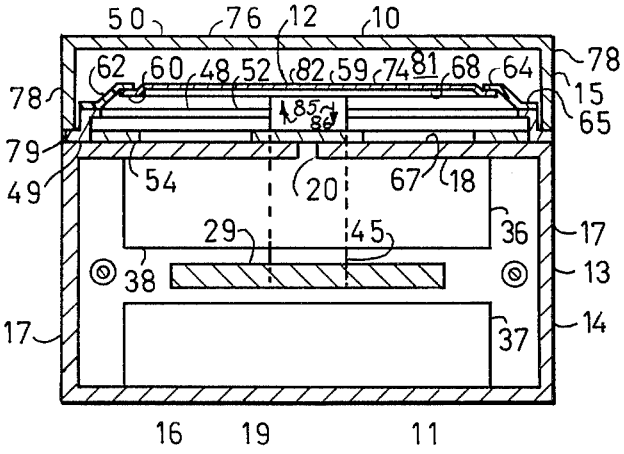

The driver 11 illustrated is adapted for connection with a push-pull amplifier in a conventional hearing aid circuit and has center, as well as, end tap leads for the coil. In its normal mode of operations, the diaphragm 12 is driven through the connector 45 so that it vibrates and successively moves in opposite directions indicated by arrows 85 and 86 (FIG. 6). When the diaphragm 12 moves in the direction of arrow 85, a sound compression is created in chamber 81 and when it moves in the direction of arrow 86, a rarefaction occurs in the chamber 81. These are transmitted to the exterior through the sound pressure outlet 84. On the other hand, when diaphragm 12 moves in the direction of arrow 85, a sound rarefaction occurs in the chamber 67 at the back side of the diaphragm while a compression occurs in this chamber 67 when the diaphragm moves in the direction of arrow 86. These sound pressure waves, however, are confined to the chamber 67.

Use of the transducer 10 as the sole transducer component of an earphone in a hearing aid system has shown by experience that the compressions and rarefactions created in the chamber 67 at the back side face 68 of the diaphragm 12 cause vibrations of the housing 13 and which are transmitted to the case. These mechanical vibrations are in turn, transmitted to the surrounding air and traverse a path back to the microphone and create a feedback problem.

Reference is now made to FIGS. 7 and 9 and wherein contain principles of the invention are seen as embodied in an earphone 99 that is illustrated for use in a conventional pocket or body style hearing air system. This type hearing aid has a separate case which houses the microphone and amplification system, and the earphone is electrically connected through a flexible cord attachment 101 between the separately encased components, as is well known. The principles however, may also be embodied in other types of hearing aids that utilize an ear mold, such as one of the eyeglass type hearing aids or, one of the behind-the-ear or in-the-ear types and where the microphone and output tranducer usually share a common case or housing and are even more closely located than in the body types.

Referring to the drawings, the electroacoustic transducing means 100 is illustrated as mounted in the internal cavity 107 of a generally conical metal outer case 102 in the earphone 99 depicted in FIGS. 7–9. Along the axis 137 of the case, the case 102 is provided with a sound passageway 103 which terminates at the truncated end 105 of the casing in a conventional nubbin 104 for reception of the ear mold 110. Coaxially arranged with the sound pressure opening 106 provided by the passageway 103 is a cylindrical cavity 107 that is open at the other end 108 of the case for reception of the transducer components during assembly of the parts. Here, the case 102 is provided with a molded plastic cover 109 that is adapted to receive a bayonet type electrical connector 130 at the end of the cord attachment 101.

At the cover end 108, the case has an annular recess 112 which surrounds the cylindrical wall 113 of the cavity 107 in a coaxial arrangement. This recess 112 is arranged to provide an annular shoulder 114 that surrounds the cavity wall 113 in the case structure and here, the earphone 99 has a flat electrically nonconductive ring or annular member 115 that surrounds the wall 113 and rests against the shoulder 114. This member 115 carries a pair of arcuate elctrical connectors 118 that project beyond a chordal flat 119 in the insulating ring structure. Diametrically opposite the flat 119, the member 115 has a notch 116 that is adapted to fit a radially projected protuberance 117 in the cylinder wall 113 for purposes of indexing the connector arrangement during assembly of the parts.

The case has an outer cylindrical flange 120 that surrounds another annular shoulder 122 provided by the structure of the recess 112. The cover 109 has a radially extending annular lip 121 that snaps into the flanged area of the case 102 to rest against the shoulder 122. The cover 109 has an inside protuberance 123 that fits in another notch 124 in the ring structure 115 so as to also index the cover with respect to the arcuate connectors 118 in the assembly. Opposite the protuberance 117, the cover has an internal land 125 with a slot 126 for receiving the bent ends 127 of the electrical connectors 118, in the assembly 99. Diametrically opposite the land 125, the cover is provided with another land or flat 128 that serves to bear against the ring 115 to provide a force moment for maintaining the ends 127 of the connectors in proper positions in the slot 126 for contact with the outer bayonets 129 of the connector 130. The bayonets extend through appropriate holes 131 in the case and the outer or shorter bayonets 129 engage the bent ends 127 of the connector 118 in the slot. These connectors 118 are connected by leads (not shown) to the end taps ot the transducer coils. The center bayonet 132 of connector 130 projects into another notch 133 in the cavity wall 113 and engages a wire 134 that is connected by leads (not shown) to the center taps of the transducers coils.

The transducing means 100 illustrated in FIGS. 7–10 is schematically illlustrated in FIG. 11 as a component of a hearing aid and is made up of a pair of electroacoustic transducers 135 and 136 that are structurally the same as the transducer 10 illustrated in FIGS. 1–6. Transducer 135 has a housing 138 that houses a driver 139 and a diaphragm 141. The driver 139 is connected by means of a connector 146 to the diaphragm 141 so as to vibratively drive the diaphragm in response to the amplifier output signal. The cover 147 of the housing 138 has a sound pressure outlet 148 that communicates with the chamber 149 at the front face 150 of the diaphragm and the chamber at the back face 151 of the diaphragm, is designated at 152. Transducer 136 has a housing 153 that houses a driver 154 and a diaphragm 156. The drive 154 is connected by connector 161 to the diaphragm 156 so as to also vibratably drive the diaphragm in response to receipt of the amplifier output signal. The cover 162 of the housing 153 has a sound pressure outlet 163 that communicates with the chamber 160 at the front face 164 of the diaphragm, and the chamber at the back face 165 of the diaphragm is designated at 166.

Transducers 135 and 136 are symetrically mounted in the cavity 107 in reference to a plane containing the axis 137 of the case 102 and with the top walls of the transducer covers 147 and 162 securely fixed together in a face-to-face relation. This arrangement is preferred since it places the outlets 148 and 163 in close proximity for coupling with outlet passageway of the case. However, an arrangement where the bottom walls of the driver components are contiguous may be used. As thus arranged, the sound pressure outlets 148 and 163 of the transducers communicate with the passageway 103 defining the sound pressure outlet opening 106 of the case, and thus also with the sound bore 167 of the ear mold 110. As thus oriented, the diaphragms 141 and 156 are also arranged in a face-to-face relation and are spaced apart in a manner such the sound pressure chambers 149 and 160 occupy the space between the diaphragms. As such, the sound pressures developed by the diaphragms 141 and 156 are delivered through the outlet 148 and 163, and thence, through a passageway 103 to the bore 167 of the ear mold. The housings 138 and 153 are secured in the cavity 107 by plastic material 200 that is hardened in the cavity 107 and serves to fix the transducer relative to the case.

The transducers 135 and 136 are electrically connected to the amplifier through leads (not shown) that pass from the cavity 107 through notches 170 at the cover end of the cavity wall 113. The leads from the end taps of the coils of the drivers 139 and 154 are appropriately connected to the arcuate connectors 118 that are arranged for a contact with the outer bayonets 129 of connectors 118 while the leads (not shown) to the center taps of the coils are electrically connected to the notch located wire 134 contacted by the center bayonet 132 of the connector 130. These connections are such that the drivers 139 and 154 vibratively drive the diaphragms 141 and 156 in phase and with equal amplitudes of vibration but in opposite directions. As such, during the same half cycle of amplified signal, diaphragm 141 moves in the direction of arrows 171 and diaphragm 156 moves in the direction of arrow 172. On the other hand, diaphragm 141 moves in the direction of arrow 173 as diaphragm 156 moves in the direction of arrow 174 during the next half cycle of the amplified signal.

Reference is now made to the hearing aid 180 schematically illustrated in FIG. 11. Here, the microphone 181 and amplifier 182 are as housed in a separate case 183 that may be carried in a pocket of the users. The transducing means 100 of the earphone 99 is housed in the case 102 with each of the transducer components 135 and 136 being wired to receive the amplified signal 185 that is delivered to the transducers from the amplifier 182 by the leads of the cord attachment 101. Thus, the driver 139 of transducer 135 receives the amplified signal and via its connector is arranged to drive the diaphragm 156. The sound pressure outlets 148 and 163 from the sound pressure chambers 149 and 166 communicate with the sound passageway 103 of case 102 and pass through the opening 106 and via the sound bore 167 of the ear mold 110 to the ear canal 184 and ear drum 186 of the user.

Operationally, sound pressure received at the input microphone 181 generates a signal 187 which is amplified in the amplifier 182 and passed by the cord attachment 101 to the earphone 99, and more particularly to each driver component 139 and 154 of the transducing means 100. The drivers 139 and 154 in response to the amplified signal drive the respective diaphragm 141 and 156 in phase but in opposite directions as previously indicated. The vibrational movements of diaphragms 141 and 156 create sound pressures in chambers 149 and 160 which are then transmitted through the outlets 148, 163, to combine in passageway 103. From here the pressures pass via bore 167 to the ear canal 184 to cause vibration of the ear drum 186.

Chambers 149 and 160 are coupled through passageway 103 and the outlets 148 and 163 to the bore 167 leading to canal 184 and this arrangement provides a closed acoustical path between the diaphragms 141 and 156 and the ear drum 186 so that there is no air link between the diaphragms and the microphone for the feedback of the sound pressures generated by the transducers. With the symetrical arrangement of the transducers, the moments of inertia of the moving parts of the transducers cancel out in the structural arrangement so that mechanical vibrations of the case due to the mechanical linkages between the drivers and diaphragms are minimized. The sound pressures generated in the closed acoustical chambers 188 and 189 of transducers 135 and 136 are furthermore adaquately confined in the transducer housings in the arrangement so that substantially no sound pressure induced mechanical vibrations are developed for transmission to the case and which would otherwise establish an air feedback path for the transmission for the transmission to the microphone of sound pressures radiating from the case.

The function of the transducing means 100 of the earphone 99 is, of course, to translate the amplified signal into audible sound pressures. In practice, each of the diaphragms 141 and 156 has a maximum dimension that is less than the wave lengths of the sound pressures generated by the transducers 135 and 136. It is also preferred that the maximum diametric dimension of the case be less than the wave lengths of the generated sound pressures for such also tends to avoid odd modes of case vibrations. Such is readily realized in earphones adapted for use in body style hearing aids as well as other types where the case additionally encloses the microphone and amplifier.

I claim:

1. A hearing aid comprising output transducing means for translating an amplified electrical signal into audible sound pressures and having a pair of transducers, a case housing said transducers and having a sound pressure outlet passageway, and means within and rigidly fixing said transducers to said case, each of said transducers having housing/component, a vibratably drivable diaphragm with opposite faces and located within said housing component, an acoustically sealed chamber located within said housing component at one of said faces, and a sound pressure chamber located within said housing component at the other of said faces, said housing component having an outlet that communicates with said sound chamber and with the outlet of said passageway, said diaphragm being arranged in a face to face relation with respect to the other said diaphragms, said sound pressures having wave lengths that exceed the maximum dimension of each of said diaphragms,and each of said transducers having means located within its housing component for driving its diaphragm in phase with but in opposite directions to the diaphragm of the other transducer.

2. In a hearing aid having an outer case with an internal cavity and a sound pressure outlet passageway that communicated with the cavity, and output transducing means for translating an amplified electrical signal into audible sound pressures, the improvement wherein said output transducing means is located in said cavity and comprises a pair of vibratably drivable diaphragms which are spaced apart and symetrically arranged in a face-to-face relation, means housing said diaphragms having sound chamber means communicating with said sound pressure outlet passageway, and a pair of chambers which are acoustically sealed from the exterior of the housing means and subjected to sound pressures generated by the respective diaphragms, and driving means housed by said housing means and responsive to said signal for vibratably driving said diaphragms in phase and in opposite directions to produce said audible sound pressures within the sound chamber means, and wherein said cavity contains means rigidly securing said housing means to said case.

3. The improvement in accord with claim 2 wherein the wave lengths of said audible sound pressures exceed the maximum dimension of said case.

4. The improvement in accord with claim 2 wherein the wave lengths of said audible sound pressures exceed the maximum dimension of each of the diaphragms.

5. The improvement in accord with claim 2 comprising an ear mold mounted on the case and having a bore communicating with the outlet of said passageway for transmitting the audible sound pressures to an ear canal.

6. The improvement in accord with claim 2 wherein said driving means comprises a pair of electromagnetic drivers that are respectively drivingly connected to said diaphragms, each of said drivers being responsive to the amplified signal to vibratably drive the diaphragm connected thereto in phase with but in opposite directions to the other diaphragm.

7. The improvement in accord with claim 6 wherein the wavelengths of said sound pressures exceed the maximum dimension of each of the diaphragms.

8. The improvement in accord with claim 6 wherein said housing means comprises a pair of housing respectively housing said drivers and the diaphragms connected thereto, each of said housings having a sound chamber with a sound pressure outlet that communicates with the outlet of said passageway.

9. The improvement in accord with claim 8 wherein the wavelengths of said sound pressures exceed the maximum dimensions of each of said housings.

10. The improvement in accord with claim 8 comprising an ear mold mounted on the case and having a bore communicating with the outlet of said passageway for transmitting the audible sound pressures to an ear canal.

* * * * *